United States Patent [19]

Barch et al.

[11] Patent Number: 4,491,082

[45] Date of Patent: Jan. 1, 1985

[54] CYLINDRICAL SLEEVE APPLICATOR FOR USE IN MANUFACTURING CHEMICALLY TREATED FILAMENTS

[75] Inventors: Herbert W. Barch, Natrona Heights; George T. Salego, Brackenridge; William H. Retsch, Castle Shannon; Rudolph Blair, Gibsonia, all of Pa.

[73] Assignee: PPG Industries, Inc., Pittsburgh, Pa.

[21] Appl. No.: 364,367

[22] Filed: Apr. 1, 1982

[51] Int. Cl.[3] ..... B05C 1/08

[52] U.S. Cl. ..... 118/234; 118/244; 118/DIG. 15; 101/375; 29/113 R; 29/129.5

[58] Field of Search ..... 29/129, 129.5, 125, 29/132, 113 R; 118/234, 244, DIG. 15; 101/375

[56] References Cited

U.S. PATENT DOCUMENTS

| | | | |
|---|---|---|---|
| 850,892 | 4/1907 | Ball | 29/129 X |
| 1,036,671 | 8/1912 | McDevitt | 29/129.5 X |
| 2,224,149 | 12/1940 | Fisher | 65/3 R |
| 2,272,588 | 2/1942 | Simison | 65/3 R |
| 2,300,736 | 11/1942 | Slayter et al. | 65/3 R |
| 2,728,972 | 1/1956 | Drummond et al. | 28/1 |
| 2,908,068 | 10/1959 | Biel et al. | 29/121 |
| 2,968,278 | 1/1961 | Wolfe | 118/257 |
| 3,006,277 | 10/1961 | Willard | 29/113 R X |
| 3,414,956 | 12/1968 | Genson | 28/59 |
| 3,506,419 | 4/1970 | Smith et al. | 65/3 R |
| 3,817,728 | 6/1974 | Petersen | 65/3 R |
| 3,920,431 | 11/1975 | Reese | 65/3 R |
| 3,977,854 | 8/1976 | Fulmer et al. | 118/63 X |
| 4,015,559 | 4/1977 | Sears et al. | 118/234 X |
| 4,071,341 | 1/1978 | Bohy et al. | 118/238 X |
| 4,088,468 | 5/1978 | Roberson | 118/63 X |
| 4,115,088 | 9/1978 | Walker | 118/65 X |
| 4,160,048 | 7/1979 | Jaeger | 427/142 |
| 4,222,344 | 9/1980 | Parbhoo | 118/68 |

FOREIGN PATENT DOCUMENTS 1072875 6/1967 United Kingdom ..... 118/DIG. 15

*Primary Examiner*—John P. McIntosh

*Attorney, Agent, or Firm*—Kenneth J. Stachel

[57] ABSTRACT

Textile filaments are treated with chemical solutions during their manufacture and a longevous apparatus is provided to accomplish this treatment. The apparatus is a cylindrical sleeve engaged with a rotating engaging means for a substantial portion of the sleeve length and the sleeve and means are disposed to be contacted with the chemical solution contained by a receptacle. The peripheral surface of the sleeve is disposed in relation to the receptacle so that the sleeve comes in contact with the moving textile filaments. The sleeve can be a graphite, metallic or metallic coated noncorroding material. The sleeve can have a thickness ranging from a foil to a thickness which allows the sleeve to be coated with a metallic coating. The rotatable engaging means can be a noncorroding material such as stainless steel, a thermosetting polymer, graphite or rubber.

The rotatable engaging means having mounted thereon the cylindrical sleeve for a substantial portion of length of the cylindrical sleeve can be horizontally disposed in the receptacle, where the receptacle has an opening at one end where the peripheral surface of the sleeve occupies the opening. This occupation can be arranged where the sleeve is adjacent to the opening or actually protruding through the opening. When the sleeve has a thickness of greater than 1.25 millimeters the sleeve can be coated with a metallic coating through a spray or sputtering process. The metallic coating is finished to a mat or a mirror finish. The sleeve is engaged upon the rotatable engaging means in such a manner that it can be easily removed from the engaging means.

13 Claims, 6 Drawing Figures

CYLINDRICAL SLEEVE APPLICATOR FOR USE IN MANUFACTURING CHEMICALLY TREATED FILAMENTS

The present invention relates to an apparatus for applying a coating to textile filaments. More particularly, the present invention relates to an apparatus having a cylindrical sleeve used to transfer chemical solutions to the moving textile filaments as they are drawn or attenuated from a source.

In the manufacture of textile filaments, various chemical treatments are applied to the filaments. Such treatments include binders, sizes, dyes and the like. In the manufacture of glass fiber filaments, chemical sizes and binders are applied to protect the filaments from intrafilament abrasion when the filaments are gathered into strands, and to render the glass fibers compatible with matrix polymers, when the glass fibers are used as reinforcement for polymeric materials.

The manufacturing techniques for producing textile filaments are acquiring the capability of drawing or attenuating increasing numbers of filaments from a source and gathering the filaments into one or more strands and collecting the strands into usable packages as continuous or chopped strands at higher and higher speeds. In the past, the chemical solutions that were applied to the moving textile filaments were applied by the use of pads, rollers, sprays and belt applicators. In processing the larger number of textile filaments at higher speeds, metal rollers have been used to apply chemical solutions to the moving filaments. The metal rollers are usually located in receptacles containing the chemical solution, where the roller picks up the chemical solution at one point in the receptable and transfers it to another point in the receptacle, where the roller contacts the moving textile filaments. These textile filaments are traditionally moving in spaced apart relation to each other and in a rectilinear direction.

The manufacture of glass fibers involves the attenuation of the glass filaments from small orifices in a bushing of a glass melting furnace having the molten glass. The filaments are attenuated at linear speeds usually on the order of 2,000 to 6,000 meters per minute or more. The filaments are attenuated by a winder which collects the filaments or strands into a package, or by a chopper which chops fibers or strands into various lengths. At some point along the travel of the glass filaments from the bushing to the attenuating device, the chemical solution is applied to the fibers. With the higher number of fibers being drawn from a single bushing and with the use of higher and higher processing speeds, the metal applicator rolls used to apply chemical solutions from a receptacle to the fibers are worn to such a degree that they must be changed with increasing frequency. When changed, the metal rolls must be resurfaced to delete the nicks and cuts due to the filaments and to restore a uniform finish to the roll. Such a refinished roll is capable of being used again for applying the chemical solutions to the glass filaments. The frequent changing of the metal rolls located in various styles of receptacles involves considerable effort, since the metal rolls usually are connected in some fashion to a motor to provide rotation of the roll within the receptacle. This means that the drive mechanism between the motor and the roll must be disconnected and roll removed for finishing. It would be advantageous to have an applicator system which would shorten the frequency or the period of time for removing metal rolls from applicator receptacles.

It is an object of the present invention to provide a roll type device, which is removed more easily from an applicator receptacle having a chemical solution that is to be applied by the roll to moving textile filaments.

It is a further object of the present invention to provide a roll-type applicating device, which needs less frequent changing in a receptacle containing a chemical solution that is transferred to moving filaments by the roll-type device.

SUMMARY OF THE INVENTION

In accordance with the present invention, an applicator roll for use in conjunction with a receptacle containing a chemical coating is provided for applying the chemical coating to textile filaments. The applicator roll is more easily changeable, when a worn applicator roll must be replaced in its position in relation to the receptacle and the textile filaments.

The present invention is an applicator roll used in conjunction with a receptacle for applying chemical solutions to textile filaments. The applicator roll has a cylindrical sleeve of a varying diameter and the sleeve has a thickness ranging from a foil to a rigid cylinder. This sleeve is engaged to a rotatable engaging means for a substantial portion of the length of the sleeve to provide rotation of the sleeve in the same direction as the moving filaments. This applicator roll is used with a receptacle adapted to contain the chemical solution to be applied to the moving textile filaments. The receptacle delivers the chemical solution to one longitudinal portion of the surface of the cylindrical sleeve, and the sleeve rotates to transfer the chemical solution to the textile filaments contacted by the rotating sleeve. The textile filaments, when contacted by the sleeve, are moving in the same direction as the direction of rotation of the sleeve.

The cylindrical sleeve having a thickness on the order of a foil is used with a rotatable engaging means to engage it securely and to maintain the cylindrical shape of the sleeve. Such a rotatable engaging means would be an expanding member which engages the cylindrical sleeve for its entire length. Such an expanding member includes inflatable rubber rolls and metal rolls with a surface that is bifurcated along the longitudinal axis and that has expanding or retracting means for the bifurcated sections. The expanding means expands the two sections of the roll or the retracting means reduces the two sections of the roll so the diameter of the roll can be varied to position the sleeve on it and to engage the sleeve. When the sleeve is not engaged to the rotatable engaging means by expansion of the diameter of the means, the means may have a capturing means that engages a capturing means on the sleeve to provide for secure engagement of the sleeve to the rotatable engaging means. The rotatable engaging means can be a mandrel which is solid and contacts the entire length of the sleeve for engagement, or the means may be a hollow cylinder thick enough to support the sleeve and provide rotation to the sleeve. The means may contact a minimum length of the sleeve that is sufficient to provide a stable rotation of the sleeve to apply chemical solutions to any number of textile filaments.

The receptacle to provide contact between the chemical coating and the cylindrical sleeve can be any receptacle that holds or contains a supply of chemical solution or from which chemical solution can be removed and applied to the sleeve. Examples include a housing in which the sleeve and rotatable engaging means are horizontally positioned, wherein the housing has a reservoir of chemical solution at the bottom. The chemical coating, which is any binder or size to be applied to textiles such as hot melt chemical materials and aqueous and nonaqueous chemical solutions, is provided by a supply conduit. The sleeve upon rotation contacts the reservoir picking up the material on its surface and transferring it to another location in the housing. At this location, the textile filaments contact the surface of the sleeve and the chemical solution is applied to them. Also, the receptacle may be one where chemical solution can be sprayed onto the surface of the sleeve for application to textile filaments at some other location in the housing and any excess chemical solution that may drip off the sleeve is caught in a basin and either recirculated or discarded. Also, the receptacle may contain a reservoir of chemical solution which is applied to the sleeve outside the receptacle by a delivery conduit or a spray. The sleeve picking up the chemical solution at this point on its surface moves the chemical solution through rotation to another point, where the sleeve contacts the glass filaments.

The sleeve may be coated with a finished coating, which gives a surface having a Rockwell hardness of around "C" 40 or greater. Such coatings can be formed from heavy metal carbides such as tungsten carbide, cemented carbides and tungsten carbide based cemented carbides with the addition of titanium, tantilum, and niobium carbides, silicon carbides and columbium carbide, cobalt, nickel, nickel-chromium-boron alloys and the like. There may also be present minor amounts of chromium oxide, calcium oxide, silica and magnesia. Cobalt, nickel, or nickel-chromium-boron alloys are usually present as a soft metal binder or matrix for cementing the tungsten carbide type materials. Also, other coatings may be used such as zinc, both pure and containing six percent antimony, aluminum, high carbon steel, tin, chromium, copper, bronze, brass, babbitt, cadmium, nickel, monel, stainless steel, silver, gold, molybdenum, tantilum, nichrome and the like.

The coating is applied to a sleeve having a thickness that is substantially greater than that of a foil, which is preferably any type of noncorroding material, that has been prepared for maximum adhesion. The thickness of the sleeve required for coating is generally around at least 1.5 mm (0.05 in.). The preparation techniques include threading, grooving and blasting with sharp sand or steel grit to present a clean, fresh surface of sufficient roughness to furnish good anchorage for the coating.

The hard coating is applied to the prepared surface of the sleeve by the spray process known as powder spray metalizing, although wire spray metalizing can be used where the hard metallic materials are available in wire form and flame plating, plasma arc spraying and sputtering may also be used. After the cylindrical sleeve has been spray coated with at least 0.001 inch (0.0254 mm) of coating, the surface is treated to remove a fraction of the coating. This finished treatment is by brushing, grinding, sanding or polishing. Such a treatment gives the surface a finish ranging from a mat finish to a mirror finish.

For a more complete understanding of the present invention, reference is made to the accompanying drawings in which:

FIG. 1 is a front view of the sleeve and rotatable engaging means, here a mandrel, where the mandrel has a shaft which is adapted for attachment to a drive means to provide rotation to the sleeve through a locking mechanism.

FIG. 1*a* shows the sleeve with a rotatable engaging means having an expandable member.

FIG. 1*b* shows an inflatable rubber means and sleeve which is to be used thereon.

FIG. 1*c* shows the coated sleeve for use on the mandrel with a locking mechanism.

Figure 1:
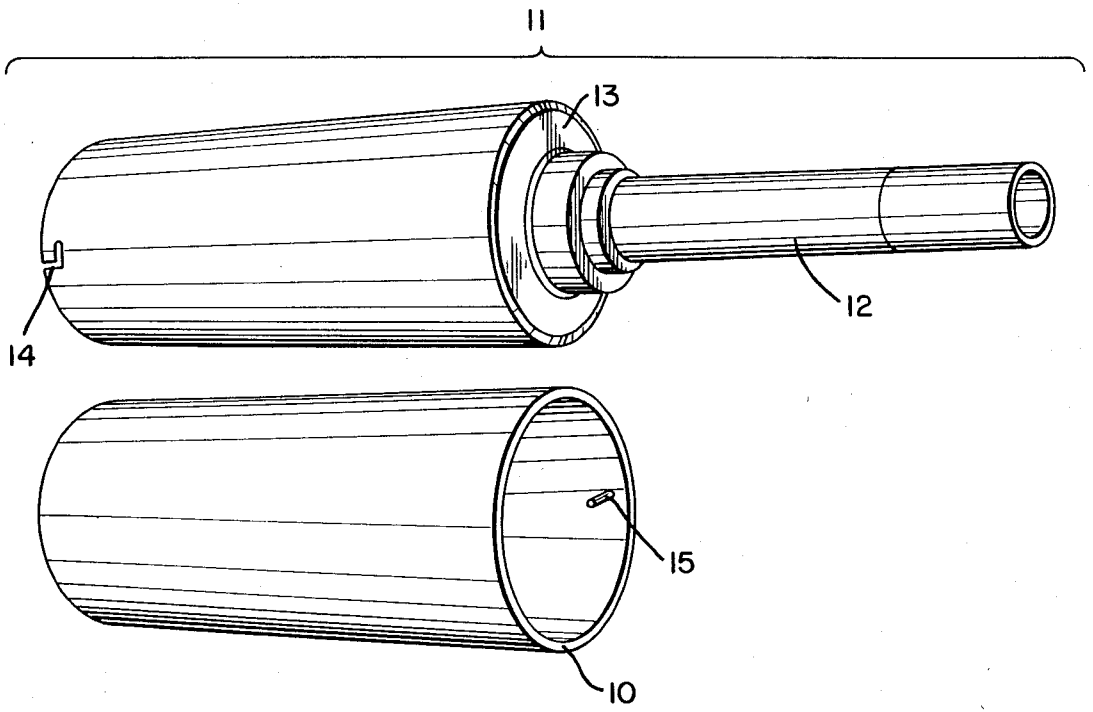

Turning to FIG. 1, there is shown the cylindrical sleeve 10, which is made of any material which is substantially noncorrosive in water and the chemical solutions to be applied to the textile filaments. Nonexclusive examples of such materials include: stainless steel, graphite, hardened carbon steels such as tin plated carbon steel, chrome plated carbon steel, aluminum, tin plated copper or chrome plated copper, tin plated brass or chrome plated brass, monel, inconel and incoloy alloys and the like. The outer surface of sleeve 10 has a finished surface which is smooth with any deformities such as nicks kept to a minimum. This finished surface can be obtained by any finishing technique, such as polishing, known to those skilled in the art to give a smooth surface. The sleeve is hollow and can have a thickness ranging from that of a foil, about 0.00025 inches (0.00635 mm) to a thicker sleeve on the order of 0.125 inches (3.175 mm) or greater. The sleeve can have a diameter from about 0.5 inches (13 mm) to 5 or 6 inches (127 to 153 mm) or greater depending upon the size of the receptacle and the space available at the location of the moving textile filaments. The sleeve has a capturing means 15 which is at one edge of the sleeve and suitable for engaging the capturing means 14 present on rotatable engaging means 11 to engage securely the sleeve 10 on means 11.

The rotatable engaging means 11 which rotates the sleeve 10 has an engaging section 13 and a drivable means section 12. The engaging means section 13 contacts the inner cylindrical surface of the sleeve to a degree sufficient to translate its rotation motion to the sleeve. Therefore, the engaging means section can be expandable to allow the sleeve to be placed on the engaging means and to allow the contact between the two for transfer of the rotational motion. Also, the engaging section 13 can be a mandrel or the like which fits securely into the center of sleeve 10. When sleeve 10 has a thickness on the order of 0.060 inches (1.5 mm) or more, the engagement of engaging means 13 is for a substantial portion of the length of sleeve 10. This substantial portion of the length is that which is necessary to provide sleeve 10 with a stable rotation, when a section of the surface of sleeve 10 contacts the moving textile filaments to apply a chemical solution to these filaments. When sleeve 10 has a thickness on the order of a foil, the rotatable engaging means should engage the entire length of the foil that is to contact the moving textile filaments. The rotatable engaging means can be hollow or solid and constructed of any substantially noncorrosive material such as stainless steel; plated carbon steel; aluminum; tin and chrome plated copper and tin plated brass, monel, inconel and incoloy alloys; graphite, rubber and polymeric materials such as thermosetting polymeric products like phenol formaldehyde type polymers, polyesters, epoxies and the like. Drivable means section 12 is attached to engaging means section 13 of the rotatable engaging means 11 in such a manner to rotate the engaging means section 13 when drivable means section 12 is rotated. The drivable means section 12 is driven in the same direction of movement of the textile filaments which accurately contact a portion of the peripheral surface of the sleeve. The drivable means section 12 is adapted to be driven by a driving means which can be any motor (not shown) preferably, an electrically energizable type motor.

The engaging means section 13 of the rotatable engaging means 11 may have a capturing means as depicted in FIG. 1. Such a means 14 engages a capturing means 15 on sleeve 10. Capturing means 15 is shown in FIG. 1 on sleeve 10. Sleeve 10 is rotated 180 degrees in the horizontal direction for mounting on engaging means 13 in order that capturing means 15 inserts into capturing means 14. This capturing means arrangement would securely hold the sleeve to the rotatable engaging means to transfer the rotational motion from the means to the sleeve. Such a capturing arrangement can be used when the sleeve 10 has a sufficient thickness and has a sufficient rigidity so that it can be held securely by the arrangement. Also, the arrangement is used when the sleeve is too thick or heavy to be rotated by an expandable rotatable engaging means.

Figure 2:
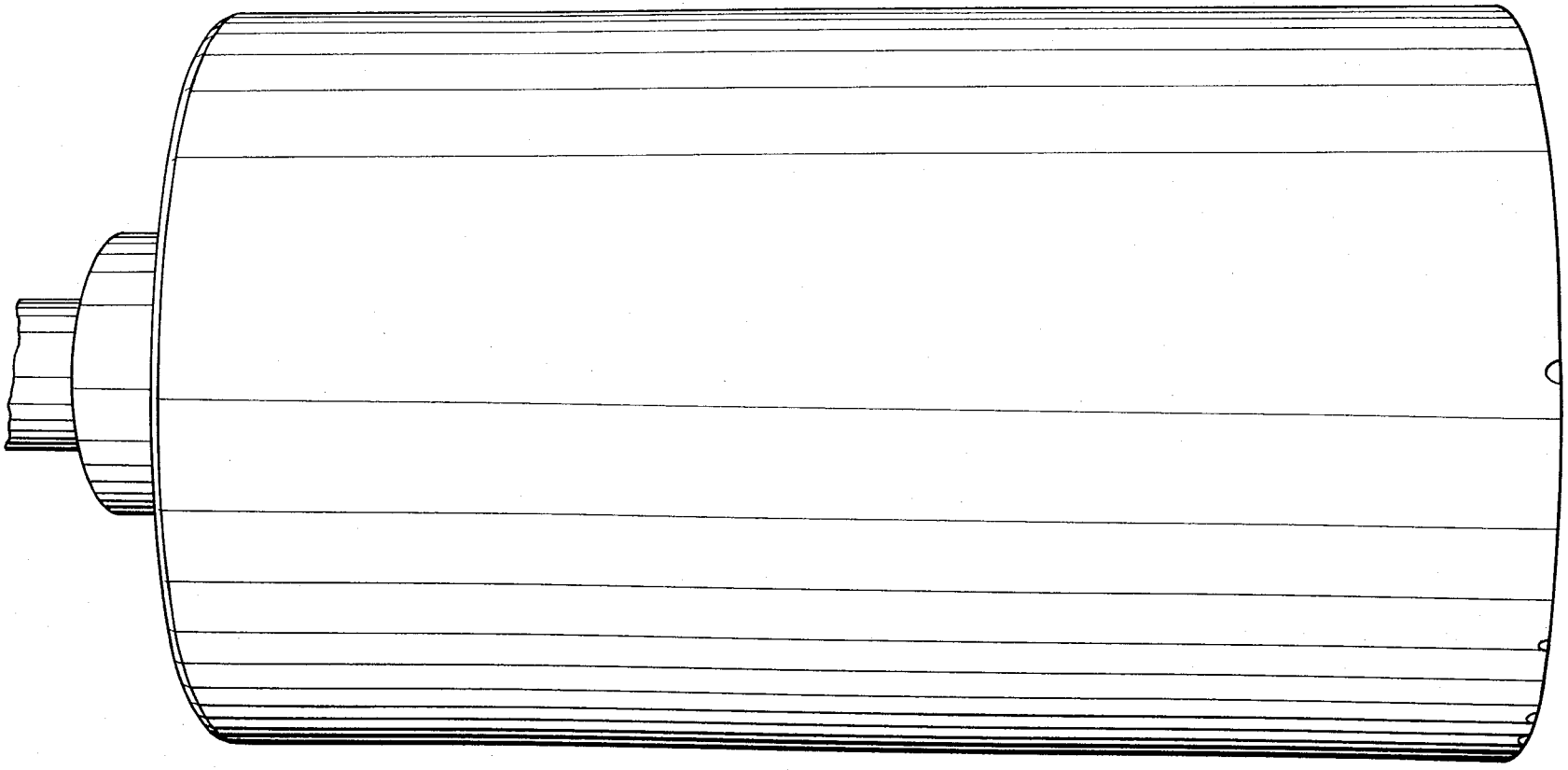
FIG. 2 is a drawing showing the surface of the coated cylindrical sleeve.

The capturing means 14 and capturing means 15 can be any system known to those skilled in the art to hold securely the sleeve and the rotatable engaging means for stable rotation of the sleeve. For instance, as depicted in FIG. 1, the capturing means 14 and 15 can be a locking means. Locking means 15 is a pin which extends for a short distance into the interior portion of the cylindrical sleeve. In this arrangement, locking means 14 would be a slot adapted to receive the pin when the cylindrical sleeve is mounted on the engaging section, here a mandrel, of the rotatable engaging means. The slot 14 would extend a distance transverse to the longitudinal line of the peripheral surface of the mandrel. This transverse extension would be in a direction opposite to the direction that the sleeve and mandrel are to be rotated. This is to prevent the sleeve from coming off the mandrel during its rotational operation. The slot of locking means 14 can be of any design to hold securely the pin of locking means 15 during rotation of the sleeve and mandrel. The slot of locking means 14 is located at the distal end of the engaging means section 13 in relation to the drivable means section 12 of the rotatable engaging means 11. The pin of locking means 15 on the sleeve can be at either end of the sleeve. In FIG. 1, the sleeve is depicted with the pin where it is located for illustrative purposes. In use, such a sleeve would have to be rotated in the horizontal direction 180° for mounting on the rotatable engaging means. This arrangement is preferred for easy removal of the sleeve from the mandrel. There are many possible variations of this locking system. For example, the pin can be located on the engaging means section 13, i.e., mandrel, and the slot located on the sleeve. In this latter arrangement, the location can be at either end of the engaging section 13 of the rotatable engaging means 11 with the use of appropriate pins or retracting pins and slots. The sleeve locked on to the engaging means section 13 is shown in FIG. 2.

Figure 1A:
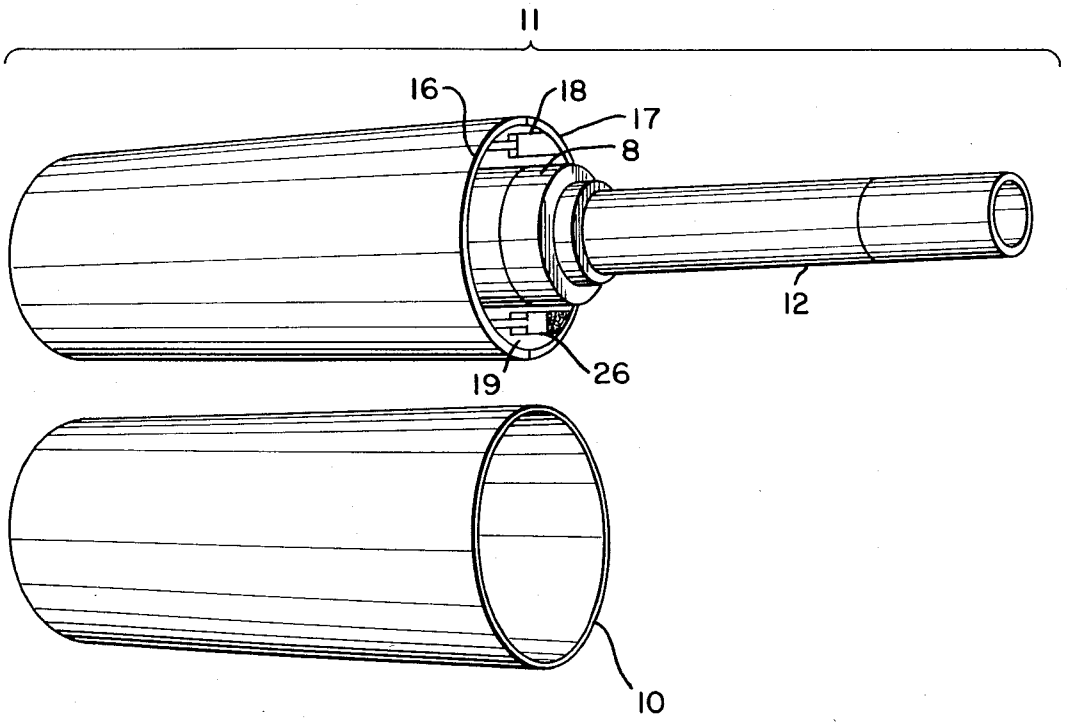

When the sleeve 10 is of a lessor thickness such as a foil, the engaging means section 13 must be modified to retain the cylindrical shape of the foil and support the foil. Such a modification can be an expandable engaging means like the expandable section of U.S. Pat. No. 4,093,137 (Briar et al), hereby incorporated by reference or like the expandable engaging means shown in FIGS. 1*a* and 1*b*. In FIG. 1*a*, the engaging means rides on shaft 12 as two distinct surface sections 16 and 17. One of these sections is attached to rotating means section 12 by attachment means 8 which attaches to the surface section 16 or 17 at a distance remote from the peripheral surface of section 16 or 17. Also, this attachment by means 8 is at a remote distance from the ends of the attached section to make a recessed offset space, 19, at each end of the attached section 16 or 17. Within this space at each end of the attached sections 16 or 17, there are located one or more piston assemblies. Two of these at one end are shown as pistons 18 and 26 which function to hold the unattached sections to the attached section 16 or 17, but which also function to allow the unattached section to expand away from the attached section. The expansion is caused by the centrifugal force generated when the rotatable engaging means 11 rotates by the rotation of drive means section 12. This causes sections 16 and 17 to expand and engage sleeve 10 to cause rotation of sleeve 10. The expansion of the unattached section from the attached section which is attached to mounting means 8 occurs through the piston assemblies that hold the unattached section to the attached section. The piston assembly has a rod attached on a bias to one of the sections, i.e., attached or unattached semi-cylindrical sections. This rod is slidably mounted and captured in a cylinder. The cylinder at one end is adapted to receive the rod. At the other end of the cylinder, it is attached on a bias to the section not having the rods attached to it. To the rod slidably mounted in the cylinder, there may be attached a spring at the head of the rod in the cylinder. The other end of the spring is attached to the closed end of the cylinder which is attached to one of the semi-cylindrical sections, 16 or 17. Such a piston is shown at piston 26. This piston assembly allows the two semi-cylindrical sections to expand away from each other. The expansion experienced is less than that due to the centrifugal force of the rotating mandrel, because of the retarding effect of the spring. The spring can be varied to have any K factor in order to vary the degree of expansion.

Figure 1B:
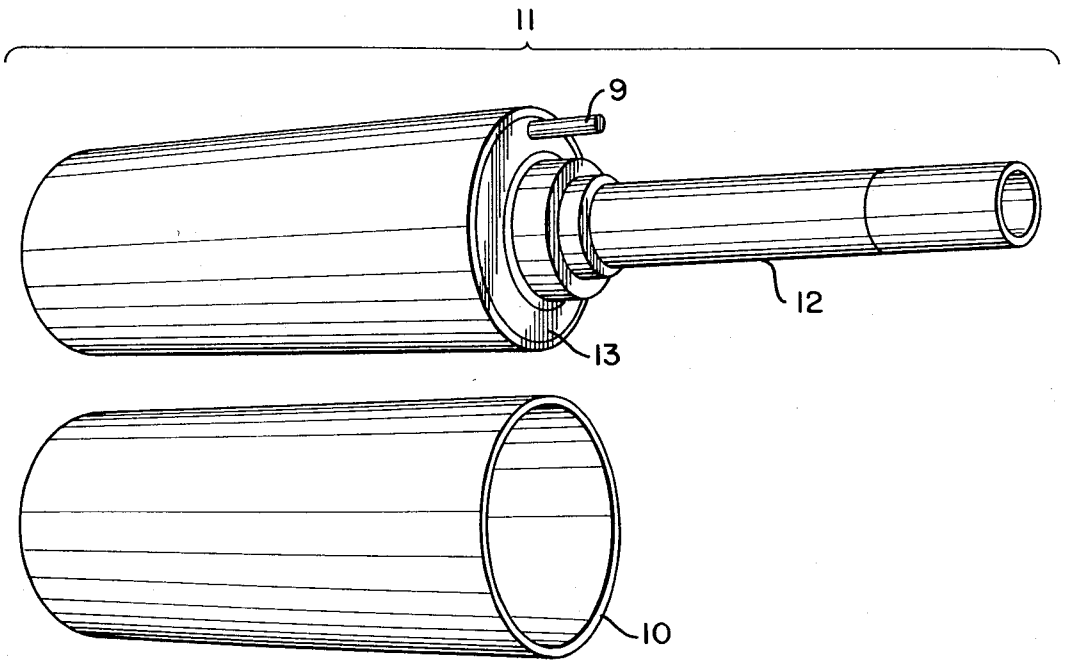

In FIG. 1*b*, sleeve 10 is mounted for its entire length on engaging means section 13, which is constructed of rubber and has a gas inflating tube 9. Once the sleeve is mounted, gas is supplied from a convenient source (not shown) and the rubber mandrel functions as the engaging means to engage sleeve 10 for rotation, when drivable means 12 is driven by a conventional drive means.

Figure 1C:
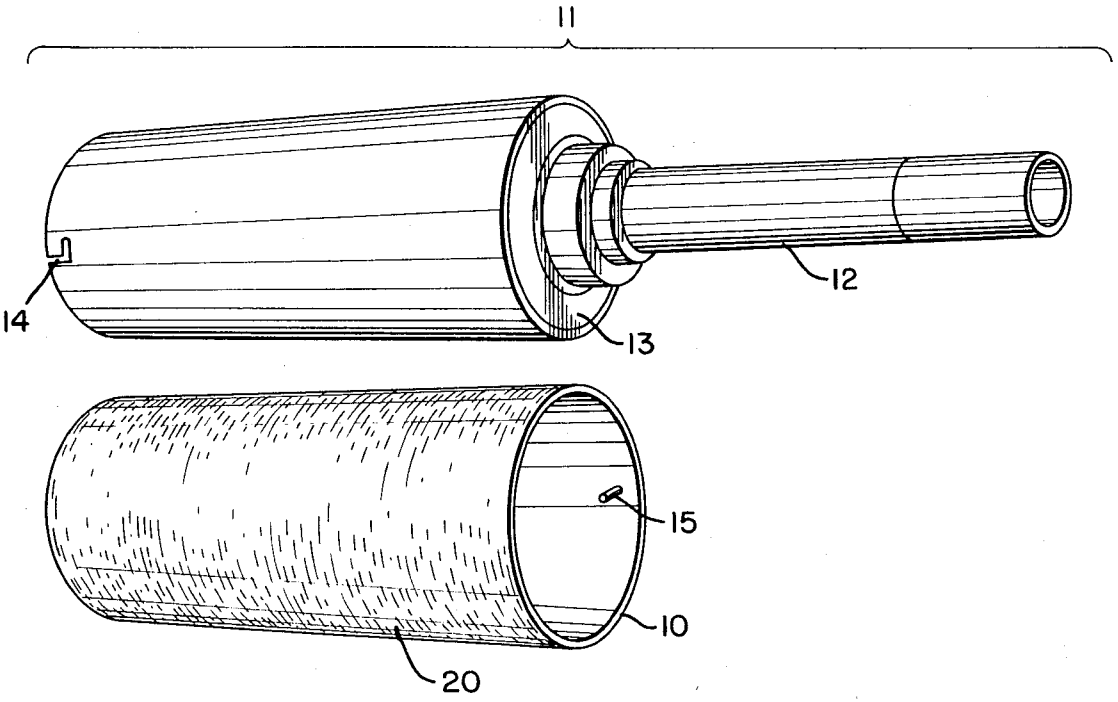

In FIG. 1*c*, the rotatable engaging means 11 of FIG. 1 is shown and sleeve 10 is shown having a metallic coating 20. The coating can be any metallic coating suitable for use in a powder spray metalizing process, wire spray metalizing process, flame plating process, plasma arc spraying process, and sputtering process and having a hardness on MOH's scale that is greater than the hardness of glass on MOH's scale. The preferred process is the powdered metalizing process which uses coatings such as zinc, both pure and containing 6% antimony, aluminum, high-carbon steel, tin, copper, bronze, brass, babbitt, cadmium, chromium, nickel, monel, inconel and incoloy alloys stainless steel, silver, gold, molybdenum, tantilum, and nichrome, and heavy-metal carbides such as tungsten-carbide cobalt and tungsten-carbide bound in nickel-chromium-boron alloys and other cemented carbides as previously mentioned. The preferred coating is the heavy metal carbide coating of tungsten carbide in cemented form. A mixture consisting of tungsten carbide of around 85–95 percent and cobalt of around 5–15 percent is used.

The coatings of the infusible materials can be produced by mixing the high melting powders with the low melting powders that fuse and bind the infusible material into the coating. The coating that is formed should have a Rockwell "C" hardness of 40 or more but should not be too high on the Rockwell "C" scale so as to produce a brittle coating on the cylindrical sleeve which could not be properly finished. These materials are sprayed through any conventional nozzle of a powder spray metalizing gun suitable for use with these metal-containing coatings. The nature of the coating formed on the cylindrical sleeve, when the particles of the spray strike the roughened surface from the pretreatment is that the particles are flattened into flakes which interlock with the irregularities of the surface and with each other to produce a characteristic structure of sprayed metallic coatings. It is preferred that materials are used which give a coating on a microscopic level consisting of laminate flakes, which are bent into corrugations. The coating is applied to a properly prepared surface, which has been roughened by any means known by those skilled in the art. These preparation techniques include threading, grooving, and blasting with sharp sand or steel grit so that a clean, fresh surface is present with sufficient roughness to furnish good anchorage for the coating. The roughening improves the adhesion of the coating to the cylindrical sleeve. The coating is applied in an amount of at least 0.001 inches (0.0254 mm.) and, preferably about 0.004 to around 0.006 inches (0.10 mm. to 0.15 mm.), greater thickness could be applied, but such application would not give any concominant benefit for the increased cost. These coatings exhibit a high degree of porosity on the cylindrical sleeve because of the existence of some solid particles in the spray.

This porous coating must be finished to a degree to enable the pick up of chemical solutions. Such finishing methods include brushing, polishing, sanding, grinding or the like. Therefore, the coating without any heat treatment after spraying is finished by wire brushing or grinding, sanding or polishing to remove at least 0.001 inches (0.0254 mm.) to 0.002 inches (0.05 mm.) from the surface of the coating. The polishing or wire brushing can be done to a greater extent to produce a mirror surface on the coated roll although a mat finished surface as appears in FIG. 2 is the preferred surface. Such brushing, polishing, grinding or sanding can be performed by any process known to those skilled in the art such as grinding wheels that avoid local overheating and the use of diamond wheels and diamond cloth paper. It is preferred that the polishing occur by sanding the coated metallic cylinder with diamond cloth paper like that available from 3M Company, Minneapolis, Minn. This diamond cloth paper is used to obtain a coating of more uniform porosity of the coated metallic cylinder. Also, the diamond cloth paper allows for polishing of the thinner coatings on the order of 0.001 inches (0.0254 mm.). An example of a powdered metalizing spray process that is useful in the present invention is that available from Syndrill Diamond Carbide Company, Cleveland, Ohio.

FIG. 2 is a photograph of the finished, coated surface that is present on the surface of the cylindrical sleeve mounted on the rotatable engaging means. This photograph shows the mat finish of the coating after finishing where at least 0.001 and preferably around 0.002 to 0.003 inches (0.05 mm. to 0.08 mm.) of the original coating has been removed, where the original coating was present in a thickness of about 0.004 to around 0.006 inches (0.10 to 0.15 mm.).

Figure 3:
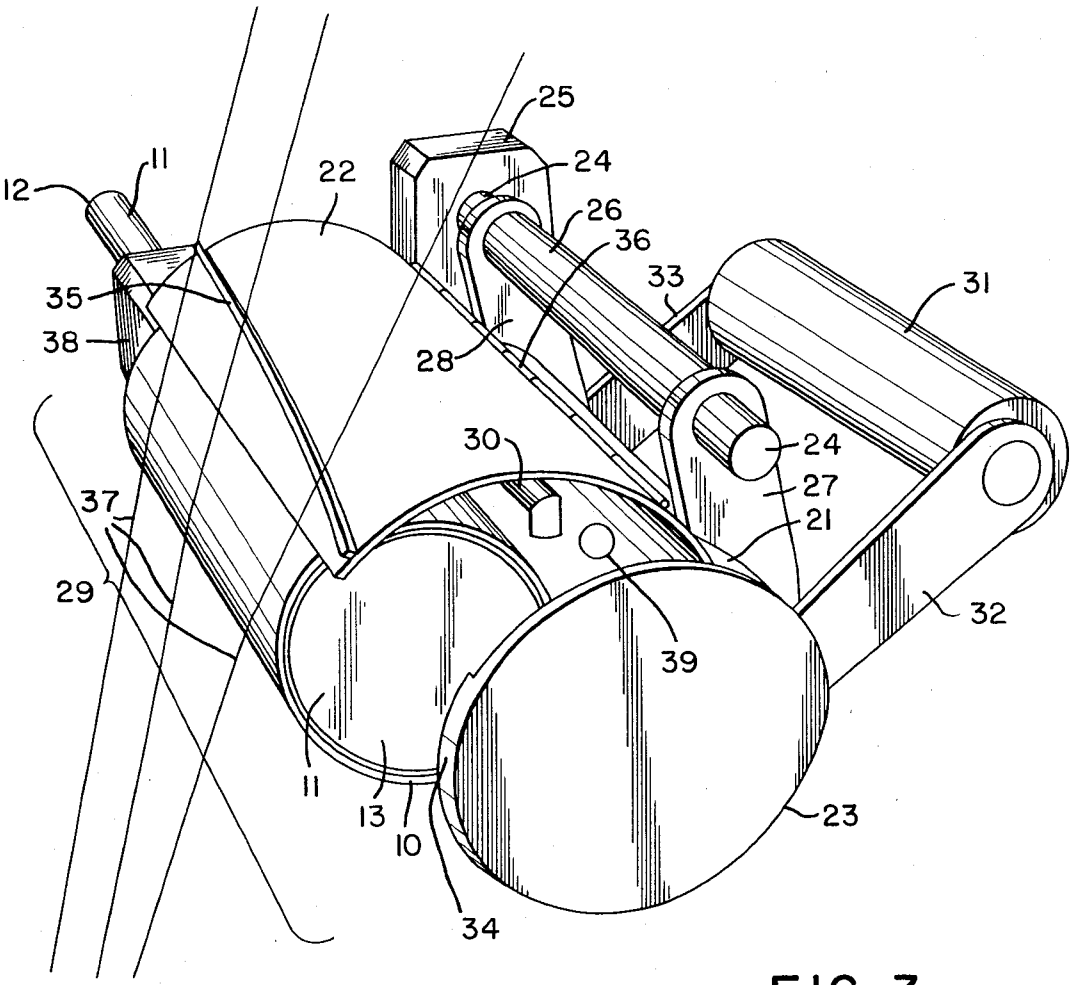
FIG. 3 is an off-centered front view of a receptable for applying chemical solutions to textile filaments, where the sleeve is positioned on the rotatable means.

FIG. 3 shows the cylindrical sleeve on the rotatable engaging means used in a receptacle to apply chemical treatments to textile filaments. The preferred receptacle is a cylindrical receptacle as shown in FIG. 3. FIG. 3 shows the receptacle that is open for access to the internal sections of the applicator receptacle. In use, the receptacle is closed so that the top section 22 rests on the side section 23 and the other side section which is not shown in FIG. 3. In FIG. 3, the applicator receptacle is shown with top portion 22 being in hinged engagement with the back portion and bottom portion of a curved member 21 so that the top can be open for easy access to the internal portions of the applicator receptacle. The back portion and bottom portion of the curved member 21 is swung away from top 22 by hinges 36. Also, supported on the back and bottom portions of the curved member 21 in its spaced apart relationship to the top 22 are arms 27 and 28. The counterweight 31 is provided on a back wall of the applicator receptacle to maintain the receptacle in a closed position during operation.

The sleeve 10 is positioned on rotatable engaging means 11, which consists of mandrel 13 as the engaging section and shaft 12 as the drivable section. The sleeve is preferably coated with the tungsten-carbide-cobalt coating applied by a powder metalizing technique in a thickness of 0.004 to 0.006 inches (0.10 to 0.15 mm) which is finished by the diamond cloth paper to remove about at least 0.001 inches (0.025 mm) of the coating. The sleeve and rotatable engaging means are mounted in the circular applicator receptacle. The sleeve on the rotatable engaging means 11 which has mandrel 13 and shaft 12, is preferably mounted in the circular receptacle applicator through one sidewall in such a way that the shaft can be rotated to rotate the mandrel with the sleeve.

The top 22 and the back and bottom portion of curved member 21 form an enclosure, where the top 22 does not meet the bottom section so as to form an opening 29. The curved member 21 has attached to it the two sidewalls 23 and a sidewall on the opposite side of the curved member to that of sidewall 23 which is not shown in FIG. 3. The shaft 12 of the rotatable engaging means 11 is positioned through the sidewall in such a manner that the sleeve 10 and the mandrel 13 portion of means 11 are horizontally disposed in the enclosure to occupy a substantial portion of the opening created by the spaced apart relationship of the top 22 and the bottom section of curved member 21. By occupying the opening, it is meant that the sleeve and rotatable engaging means have sufficient room to rotate within the enclosure and opening. Therefore, the dimensions of the sleeve and rotatable engaging means should be slightly less than the dimensions of the opening in regards to length. The sleeve and rotatable engaging means are horizontally positioned in the enclosure in such a way that the peripheral surface of the sleeve tangentially meets the opening or protrudes through the opening so that textile filaments moving toward and away from the sleeve are in arcuate contact with the periphery of the sleeve. Also, it is preferred that the bottom portion of curved member 21 extends to the front of the receptacle on both sides of the opening 29. One of the bottom extensions along the side of the opening is shown at 34 in FIG. 3. Although it is shown that the extension 34 is from the bottom portion of the curved member 21, it is also possible that the side members extend from the top portion 22 of the curved member 21 to engage or contact the bottom portion of the curved member.

The shaft of the rotatable engaging means is positioned in the applicator receptacle through the sidewall. The rotating shaft section 12 of the means 11 is mounted onto the sidewall by a mounting means 38 which provides for the rotation of shaft 12, mandrel 13 and sleeve 10. This mounting means can be any means known to those skilled in the art, which provides for such a shaft with a diameter on the order of $\frac{1}{8}$ to 2 inches and allows for rotation of the shaft through proper use of bearings and the like. It is preferred that the mounting means has a block with one set of bearings at each end of the block, where the shaft enters and egresses. It is also preferred that the direction of rotation of the sleeve and rotatable engaging means is in the same direction as the movement of the textile filaments from their source to a collecting location.

Stud 24 is mounted on support 25 which also provides support for the applicator receptacle and the mounting means 38. Stud 24 has positioned on it a sleeve 26 which is rotatable on stud 24 and is secured by arms 27 and 28 to the receptacle for its support. A conduit 29 is provided from the bottom of curved member 21 as a binder overflow conduit which is in communication with and removes chemical solutions from the applicator receptacle to maintain a constant level of chemical solution in the receptacle. In the alternative, depending on how the chemical solution is applied to the sleeve on the rotatable engaging means, this conduit can be a catch basin for any excess chemical solutions which come off of the rotating sleeve. Top portion 22 is provided with a diverter means 35 which can be of any geometric design to divert any liquid which comes in contact with the top portion 22 away from the opening beneath top portion 22. This diverter means is necessary since top portion 22 curves downward toward opening 29.

In the operation of the applicator receptacle and the sleeve mounted on the rotatable engaging means, the unit is closed to have the periphery of the sleeve protruding through the opening between the top member and the bottom section of the curved member. This receptacle can be located closer to the source of the moving textile filaments, where the fan of filaments is wider than the fan of filaments at a position closer to the gathering or collecting area of the filaments. The binder solution is pumped into the receptacle through inlet conduit 30 and allowed to overflow into the overflow conduit 39. In the alternative embodiment, the binder can be delivered to the surface of the sleeve and then conduit 39 merely catches the excess chemical solution. Counterweight 31 is attached to the receptacle by arms 32 and 33 and is of sufficient weight to maintain the receptacle containing the chemical solution closed and firmly in place during operation. The drive shaft 12 is actuated by a suitable motor (not shown) and revolved to rotate the sleeve between 1 to 180 revolutions per minute, preferably about 50 to about 60 revolutions per minute. This shaft is about 5 centimeters in diameter and has attached to it the preferred sleeve which is a hard surface coated sleeve 10 which is locked onto the rotatable engaging means section 13 by locking mechanism 14 and 15. The hard surfaced sleeve is journaled in the receptacle so that the lower most zone of the sleeve is immersed in the chemical solution preferably present as a reservoir at the bottom of the receptacle. As the hard surface sleeve is rotated on the rotatable engaging means 11, the sleeve is continuously dipped in the chemical solution and therefore, acquires a film of the chemical solution for transfer to the moving filaments.

The hard surface sleeve and rotatable engaging means section are attached to shaft 12 by any suitable means known to those skilled in the art and this arrangement is adapted to be rotated at comparatively low peripheral speed compared to the high linear speed of the textile filaments. The means illustrated for rotating the sleeve, and rotatable engaging means including the engaging means and shaft includes a motor which is preferably an electrically energizable motor (not shown). The motor shaft may be provided with a worm gear adapted for enmeshment with a worm wheel contained within a gear housing and mounted on a shaft. Secured upon this is a spur gear which meshes with a spur gear of larger diameter, the latter being secured upon the shaft 12 of the rotatable engaging means 13 supporting sleeve 10. The sleeve and rotatable engaging means are operated at comparatively low speeds through the reduction gearing afforded by the worm gear and worm wheel drive (not shown) and the differential and the size of the spur gear. Also, it is possible that the drive mechanism for shaft 12 may be a chain drive that wraps around a gear present on shaft 12 to rotate the shaft and the attached supporting means and sleeve. Also, it is possible that the sleeve and rotatable engaging means can be free wheeling so that they are turned by the speed of the filaments when the filaments contact the peripheral surface of the sleeve at opening 29. It is preferred that the rotatable engaging means and sleeve are driven with a motor so that its speed would be considerably lower than the linear speed of the filaments.

The sleeve which is on the engaging means has a diameter in the range of about $\frac{1}{4}$ inch to 5 inches or more and the engaging means section, i.e., mandrel, has a comparable diameter in order to engage the sleeve. This provides a sufficient area of contact for the moving filaments. The filaments are in arcuate contact with the periphery of the sleeve due to the angular direction of travel of the filaments into engagement with the sleeve with respect to the direction of travel of the filaments moving away from the sleeve. The chemical solution carried on the sleeve is transferred to the filaments contacting the sleeve for this distance. Strands or filaments 37 pass over the surface of the sleeve. The chemical solution is maintained at a level on the bottom of the receptacle up to a little higher than the bottom of the sleeve and is constantly fed to the receptacle via binder supply conduit 30. The overflow conduit 39 assists in maintaining this level constant during operation. The filaments or strands 37 are being attenuated from a molten source through small orifices in a bushing gathered into one or more strands and wound into a package at speeds on the order of 2,000 to over 6,000 meters per minute or more and typically at speeds of 2,600 to around 5,550 meters per minute. The applicating means, here the sleeve, passes through the binder solution maintained in the receptacle picking up the solution due to characteristics of adhesion and surface tension of the liquid chemical solution and delivers the chemical solution to the opening of the applicator receptacle 29. As the solution ladened sleeve rotates through the opening 29, the peripheral surface of the sleeve is contacted by the glass filaments or strands 37 and the solution is picked up by the glass filaments or strands.

When the coated or uncoated sleeve develops nicks and abrasions due to the textile filaments, a sleeve can be easily removed from the rotatable engaging means after the driving mechanism has been stopped or disengaged. A replacement sleeve can be placed on the rotatable engaging means and the removed sleeve can be recoated or resurfaced. Such resurfacing removes nicks and scratches caused by the textile filaments and can be accomplished by any method of grinding, polishing or resurfacing known to those skilled in the art for giving a metal roll a smooth surface. The recoating can be performed in the same manner as the application of the original coating.

In the preferred embodiment of the present invention, it is preferred that the sleeve has a locking mechanism as is shown in FIG. 1 and that the sleeve is coated with a tungsten-carbide-cobalt coating by a powder metalizing spray technique. The coating is preferably polished by removing 0.002 to 0.003 inches (0.5–0.8 mm) of the surface of the coating that was originally applied in a thickness of about 0.004 to about 0.01 inches (0.1–0.25 mm) to give a surface having a mat finish. Such a sleeve is mounted on a solid mandrel having a shaft which is horizontally disposed in a cylindrical applicator receptacle as shown and described in FIG. 3. The sleeve on the mandrel with the shaft horizontally disposed in the cylindrical applicator receptacle is driven by a motor at a slower peripheral speed than the linear speed of the textile filament tangentially contacting the peripheral surface of the coated sleeve. It is also preferred that the applicator receptacle with the sleeve and mandrel and shaft horizontally disposed in it is used for applying chemical solutions of binders and sizes to glass fiber filaments while they are being attenuated from a glass melting furnace.

EXAMPLE 1

In one typical operation of the coated metal sleeve with the polished surface of the instant invention in an applicator receptacle, involves the manufacture of glass fibers from a bushing in a molten glass furnace to produce a strand having 400 filaments. The bushing was operated to produce glass filaments having a diameter of 12.95 μm (0.012 mm). The filaments were drawn at a rate of around 3,000 meters per minute (10,000 ft/min.) and the fan of the filaments so drawn was passed over the coated metal sleeve 10 in FIG. 3. The sleeve had a diameter sufficient to fit snugly over about a 2 inch (51 mm) mandrel. The mandrel and sleeve were 5 in. (127 mm) in length. The sleeve had a thickness of 0.06 in (1.6 mm). The coating was a tungsten-carbide-cobalt coating polished with the diamond cloth paper as in the preferred embodiment. The applicator receptacle contained an aqueous solution of resinous binder plus other components. The coated metal sleeve was partially immersed in the aqueous resinous solution and was driven at a speed of 50 to 60 revolutions per minute. The filaments were gathered and cut into chopped strands having an average length of 0.125 to 1 inch (3.1 to 25 mm) package. The coated metal sleeve with the polished surface operated for about a month before it was removed for inspection, which showed no appreciable wear.

We claim:

1. An apparatus for applying coatings of binders and/or sizes to moving filaments, comprising:

a. a cylindrical sleeve having a capturing means located at a distal longitudinal end of the interior surface of the sleeve;

b. a rotatable means engaging the cylindrical sleeve through a capturing means located at the surface at the distal longitudinal end of the rotatable means and through the capturing means of the sleeve, where the distal end is distal from a drivable section of the engaging means, and where one of the capturing means is a pin extending from the surface and the other capturing means is adapted to receive and to hold securely for rotation the pin by having a slot extending a distance transverse to the longitudinal line of the surface in a direction opposite to that direction in which the sleeve and means are rotated and where the rotatable engaging means contacts the inner cylindrical surface of the sleeve to a degree sufficient to transfer rotational motion of the means to the sleeve, where the rotation is in the direction of the moving filaments, and c. a receptacle having a top, back, and bottom portion, where the top and bottom portions do not meet so that an opening is formed, and where the receptacle is adapted to contain the chemical solution that is applied to the cylindrical sleeve upon rotation, and where the sleeve is on the rotatably engaging means which is horizontally disposed in the receptacle so that the peripheral surface of the sleeve occupies the opening to allow contact between the cylindrical sleeve and the textile filaments that are moving past the receptacle so that the chemical solution applied to the sleeve is transferred to the textile filaments.

2. Apparatus of claim 1, wherein the cylindrical sleeve is a metallic cylindrical sleeve.

3. Apparatus of claim 1, wherein the sleeve is graphite.

4. Apparatus of claim 1, wherein the rotatable engaging means is a solid noncorroding mandrel with a shaft.

5. Apparatus of claim 1, wherein the rotatable engaging means is a hollow rigid noncorroding cylinder with a shaft.

6. Apparatus of claim 1, wherein the diameter of the cylindrical sleeve is at least 2 inches.

7. Apparatus of claim 1, wherein the receptacle is a housing having (a) a curved member constituting the top, back and bottom of the housing, where the member has a convex curve contour for its entire width and where the bottom extends partially up the front of the housing so as to contain a chemical solution at the bottom of the housing, and where the top is spaced above the bottom to make an opening in the front of the housing, (b) two circular sidewalls affixed to opposite ends of the curved member wherein the sidewall or back is adapted to permit a drive means to drive the rotatable engaging means.

8. Apparatus of claim 1, wherein the capturing means on the interior surface of the cylindrical sleeve is the pin exending a short distance from the interior surface of the sleeve, and the capturing means of the rotatable means is the slot that is adapted to receive the pin.

9. Apparatus of claim 8, wherein said cylinder sleeve has a coating of tungsten-carbide-cobalt applied by a powder spray metalizing technique wherein 0.001 of an inch of the coating having a thickness of 0.004 to 0.01 inch has been removed by polishing with diamond cloth paper.

10. Apparatus of claim 1, wherein the capturing means on the rotatable engaging means is the pin extending a short distance from the surface of the means, and the capturing means of the cylindrical sleeve is the slot that is adapted to receive the pin.

11. Apparatus of claim 1 wherein the cylindrical sleeve has a thickness of at least about 1.5 millimeters and has a metallic coating.

12. Apparatus of claim 11 wherein the metallic coating on the sleeve is that deposited by a process of wire spray metalizing, powder spray metalizing, flame plating, plasma arc spraying and sputtering and at least the first 0.001 inch of the coating has been removed by grinding, polishing or sanding.

13. An apparatus for applying binders and/or sizes to moving filaments, comprising:

a. a metallic cylindrical sleeve adapted to be supported for rotation and having a capturing means located at a distal longitudinal end of the interior surface of the sleeve where the sleeve has a coating of tungsten-carbide-cobalt applied with a powdered metalizing spray technique and polished to remove at least 0.001 of an inch of the original coating present in a thickness of about 0.004 to about 0.01 of an inch, b. a rotatable engaging means adapted to support the sleeve along a substantial portion of the sleeve and to rotate the sleeve in the same direction as the moving support to the sleeve and connected to a shaft to provide rotation to the rotatable means and cylindrical sleeve, wherein the rotatable engaging means has a capturing means at the surface at the distal longitudinal end of the rotatable means said distal end being distal from the shaft, and where one capturing means is a pin extending from the surface, while the other capturing means is adaptable to receive and to hold securely for rotation the pin by having a slot extending a distance transverse to the longitudinal line of the surface in a direction opposite to that direction in which the sleeve and means are rotated, c. a receptacle having a top, back and bottom portion, where the top and bottom portions do not meet so that an opening is formed and where the receptacle is adapted to contain a chemical solution and adapted to have the cylindrical sleeve supported on the rotatable engaging means horizontally disposed therein so that the peripheral surface of the sleeve occupies the opening and where the shaft of the rotating engaging means is rotatably mounted through at least one end of the receptacle so the shaft can be rotated by a drive means, whereupon rotation of the rotating engaging means, the cylindrical sleeve rotates and contacts the chemical solution along the longitudinal peripheral surface of the sleeve to pick up the chemical solution and transfer the chemical solution to the moving filaments which contact the rotating cylindrical sleeve at the opening in the receptacle.

* * * * *

UNITED STATES PATENT AND TRADEMARK OFFICE

CERTIFICATE OF CORRECTION

PATENT NO. : 4,491,082

DATED : January 1, 1985

INVENTOR(S) : Herbert W. Barch et al.

It is certified that error appears in the above-identified patent and that said Letters Patent is hereby corrected as shown below:

Column 12, line 63, delete "exending" and insert

--extending--.

Signed and Sealed this

*Seventh* Day of *May 1985*

[SEAL]

*Attest:*

DONALD J. QUIGG

*Attesting Officer*

*Acting Commissioner of Patents and Trademarks*